United States Patent [19]

Cousins III

[11] Patent Number: 4,511,896

[45] Date of Patent: Apr. 16, 1985

[54] REMOTE SENSOR SYSTEM WITH BI-DIRECTIONAL MONITORING AND CONTROL OF OPERATION

[75] Inventor: Matthew E. Cousins III, Vienna, Va.

[73] Assignee: The United States of America as represented by the Secretary of the Army, Washington, D.C.

[21] Appl. No.: 403,686

[22] Filed: Jul. 30, 1982

[51] Int. Cl.[3] ..... G08C 19/16

[52] U.S. Cl. ..... 340/870.25; 307/3; 340/825.7; 340/870.42

[58] Field of Search ..... 307/3; 340/310 R, 870.04, 340/870.07, 870.18, 870.25, 825.7, 870.43, 870.26, 870.42

[56] References Cited

U.S. PATENT DOCUMENTS

| | | | |
|---|---|---|---|
| 2,780,799 | 2/1957 | Hansson | 340/870.07 |
| 2,979,566 | 4/1961 | Hopner | 340/825.7 |
| 3,026,504 | 3/1962 | Aurand | 340/870.25 |
| 3,742,473 | 6/1973 | Hadden | 340/870.18 |
| 4,399,440 | 8/1983 | Douglas | 340/870.07 |
| 4,451,826 | 5/1984 | Fasching | 340/870.04 |

*Primary Examiner*—James J. Groody
*Assistant Examiner*—Michael F. Heim
*Attorney, Agent, or Firm*—Anthony T. Lane; Robert P. Gibson; John E. Becker

[57] ABSTRACT

An improved electronics system for transmission of low level analog signals from a remote sensor to a control terminal utilizing a single pair of unshielded wires. A bi-directional exchange occurs between the sensor and control terminal which results in power and control being provided to the sensor which transmits analog signals and sensor status to the control terminal.

7 Claims, 2 Drawing Figures

REMOTE SENSOR SYSTEM WITH BI-DIRECTIONAL MONITORING AND CONTROL OF OPERATION

RIGHTS OF GOVERNMENT

The invention described herein may be manufactured and used by or for the U.S. Government for governmental purposes without the payment of any royalties therefor or thereon.

BACKGROUND OF THE INVENTION

1. Field of the Invention

The present invention relates to an improved electronic system for use with low-level analog sensors. More specifically, the present invention relates to a system for transmitting electrical signals bi-directionally between a remote sensor unit and a control terminal unit along a single pair of unshielded transmission lines.

2. Description of Prior Art

Heretofore, low-level analog sensors such as hydrophones, geophones, and microphones, disposed at remote locations with respect to a central terminal unit have experienced various problems in the transmission of signals between the sensors and the terminal units, and the implementation of control functions at the sensor units under direction of the central terminal unit. For example, the long transmission lines which couple the remote sensor units and the central terminal units are subject to electromagnetic interference (EMI) which degrades the quality of the signals. In addition, transients such as lightning, may frequently damage the sensor units. It is also a problem to provide power to the remote sensor units to drive all of the associated electronics. For example, the low level analog output of the sensors requires amplification by electronic amplifiers before transmission to the central terminal unit. Power for these amplifiers has traditionally been supplied by batteries at the sensors or by multi-conductor cables running from the central terminal unit.

It is also necessary to be able to adjust and calibrate the sensor units and associated electronics preferably from the central terminal units. However, when control functions are initiated at the central terminal unit, it has heretofore been necessary to provide additional control lines running from the central terminal unit, adding to the system complexity and increasing the probability of system noise.

Prior art systems have also traditionally required transmission lines with suitable shielding or other circuit components and techniques to reduce electromagnetic interference (EMI).

SUMMARY OF THE INVENTION

Accordingly, it is a primary object of the present invention to provide an improved electronic system for transmitting signals bi-directionally between a remote sensor unit and a central terminal unit along a single pair of unshielded transmission lines.

It is a further object of the present invention to provide a signal transmission system wherein the low level analog signals from the sensors are FM modulated and applied to the pair of transmission lines through a balanced transformer coupling configuration, reducing the effect of EMI and providing transient protection to the system.

It is another object of the present invention to provide DC power to both the central terminal unit and the remote sensor unit along the same single pair of signal transmission lines through which signals from the sensor and control signals from the central terminal unit pass.

It is still another object of the present invention to provide a system wherein control functions at the sensor unit may be implemented at the central terminal unit by reversing the polarity of the DC power applied to the single pair of transmission lines to start a control function and stopping the control function at a desired operating point by restoring the polarity of power supplied to the lines to the original condition.

It is yet another object of the present invention to provide a signal transmission system between a remote sensor unit and a central terminal unit which may utilize inexpensive field telephone wire as the single pair of transmission lines, rather than expensive shielded transmission lines used heretofore.

The objects of the present invention are fulfilled by providing a system for transmitting electrical signals bi-directionally between a remote sensor unit which generates analog data signals, and a control terminal unit along a single pair of unshielded transmission lines comprising:

a power supply within the control terminal unit for applying D.C. power of a predetermined polarity to the pair of transmission lines for providing D.C. bias to both said sensor unit and control terminal unit, the system operating in a monitoring mode of operation wherein analog data signals from said sensor unit are monitored at said control terminal unit when the predetermined polarity is applied;

a polarity reversing device coupled to the power supply for selectively reversing the polarity of power applied to the pair of transmission lines to switch the system to an adjustment mode of operation wherein the sensor unit is adjusted to a desired operating point;

an automatic gain control amplifier within the sensor unit responsive to the polarity reversal for initiating a gain change or calibration of the sensor unit and terminating the gain adjustment or calibration at said operating point in response to restoration of the polarity to the original condition; and an FM modulator coupled to the output of the gain control amplifier and to the transmission line through a balanced transformer coupling for transmitting FM modulated analog data signals to the control terminal unit.

The system of the present invention has two basic component units, namely, a remote sensor unit and a central terminal unit coupled by a single pair of transmission lines. The signal terminal unit provides both power and control functions to the remote sensor unit. It also receives FM analog data from the sensor unit and demodulates it back into analog data.

The system has two basic modes of operation, namely, a control or adjustment mode and a data monitoring mode. In the control or adjustment mode, the sensor unit is provided with a control signal from the central terminal unit formed by reversing the polarity on the single pair of transmission lines which implements a control or adjustment program of operation. This program may initiate the calibration of the sensor unit or the adjustment of the gain of an amplifier to which the output of a sensor device is applied. This program proceeds automatically under control of suitable electronic modules provided in the remote sensor unit, and is continuously monitored at the central terminal unit until a desired operating point of the sensor unit is achieved. When this desired operating point is reached, the adjustment program may be terminated by reversing the polarity on the transmission lines back to the original value. In the data monitoring mode, the system of the present invention merely receives and analyzes analog data at the central terminal unit obtained when the sensor unit is functioning at the desired operating point.

BRIEF DESCRIPTION OF THE DRAWINGS

Other objects of the present invention and the attendant advantages thereof will become more readily apparent by reference to the drawings wherein like reference numerals refer to like parts and wherein.

DETAILED DESCRIPTION OF THE DRAWINGS

Figure 1:
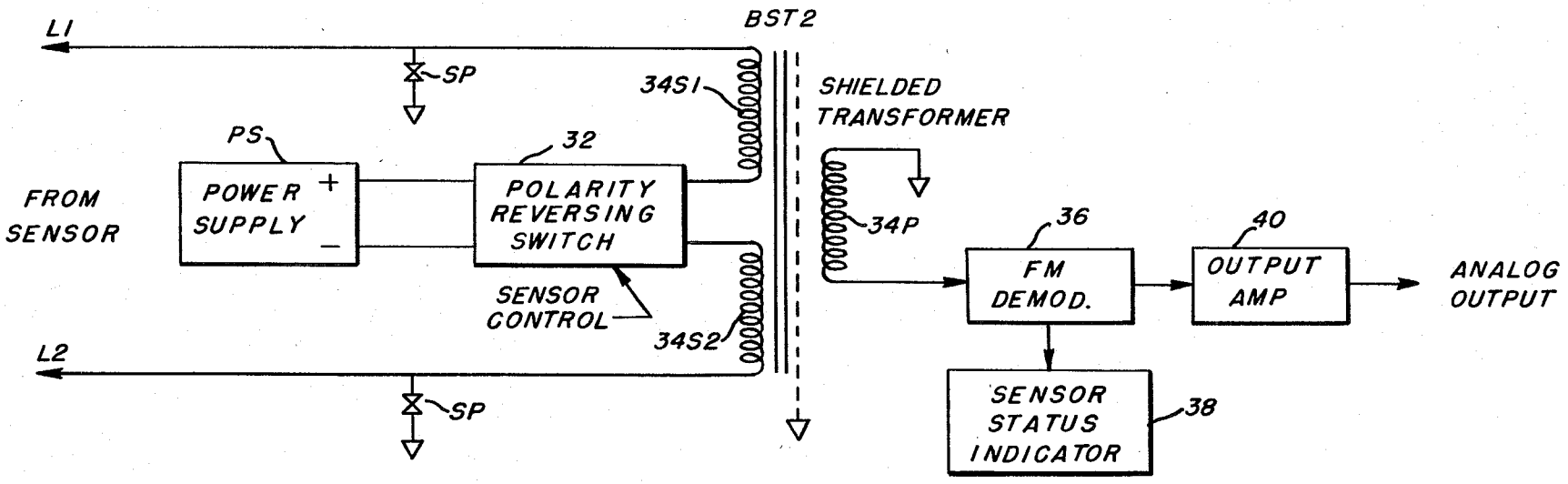
FIG. 1 is a schematic block diagram of the central terminal unit of the signal transmission system of the present invention.

Referring to FIG. 1, there is illustrated a single pair of transmission lines L1, L2, leading from the central terminal unit of FIG. 1 in the direction shown to the remote sensor unit to be described hereinafter. Power is supplied to these transmission lines by a power supply PS in a predetermined polarity. Reversal of this predetermined polarity initiates sensor control functions, to be described further hereinafter. The power supply PS is coupled to transmission lines L1, L2 through a polarity reversing switch 32 and a balanced shielded transformer BST2. Transformer BST2 includes a pair of balanced primary windings 34S1, 34S2 and a secondary winding 34P. Transformer BST2 is provided with suitable shielding for electromagnetic interference (EMI) and surge protectors SP for each of the balanced primary windings. Secondary winding 34P of transformer BST2 has one end coupled to ground and the other end coupled to the input of a FM demodulater 36. FM demodulator 36 has two outputs, one of which leads to a sensor status indicator 38 such as an oscilloscope or other visual signal monitoring device and the other output leads to an output amplifier 40 which generates an analog output signal to a recorder or other form of suitable detector.

Figure 2:
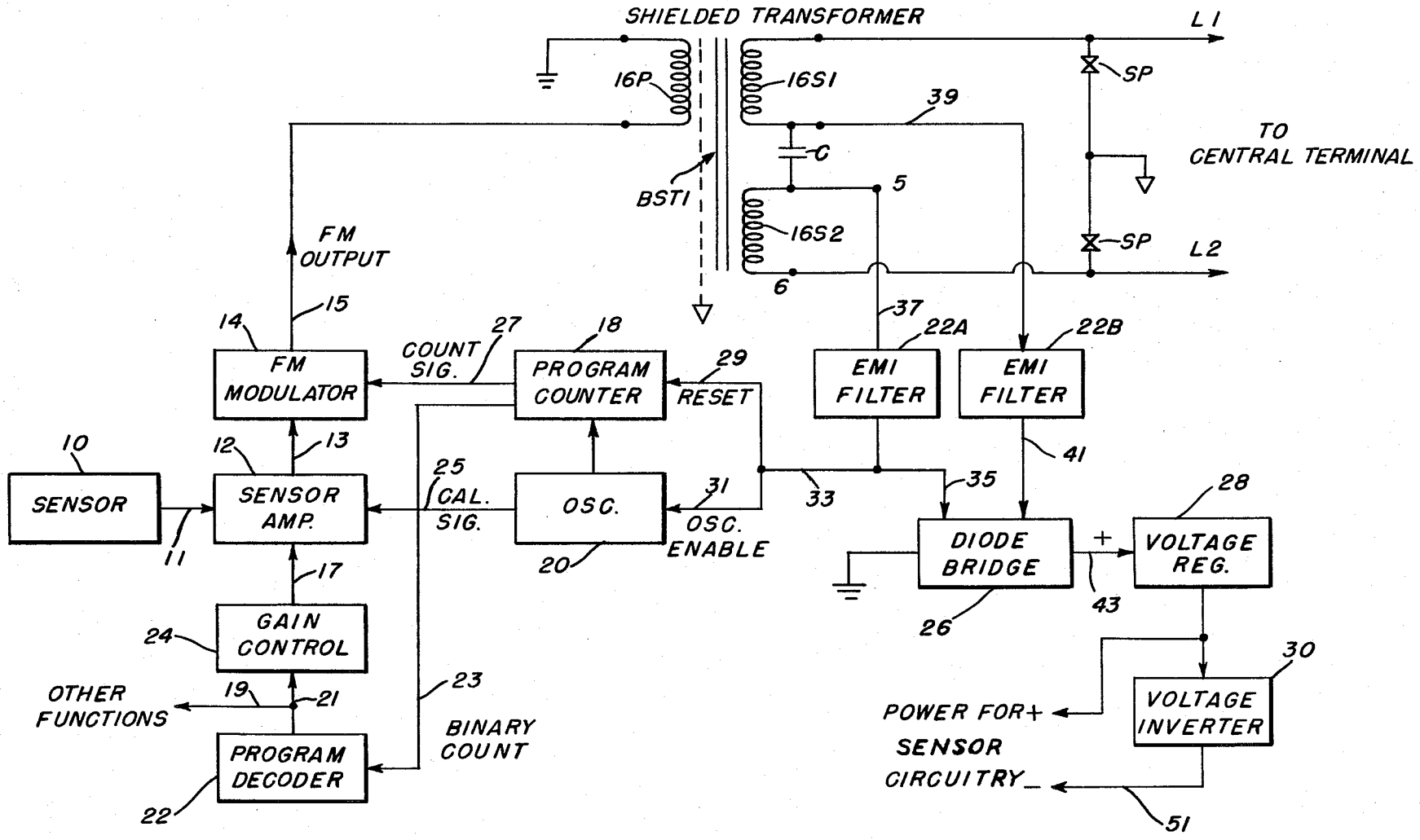
FIG. 2 is a schematic block diagram of the remote sensor unit for use with the signal transmission system of the present invention.

Referring to FIG. 2, there is illustrated a preferred embodiment of the sensor unit of the present invention including a typical analog sensor device 10 such as a hydrophone, geophone or microphone. The single pair of signal transmission lines L1, L2 comprise the same signal transmission lines illustrated in the central terminal unit of FIG. 1. Surge protectors such as SP may be provided in these transmission lines for protection against signal transients such as lightning. The power supply to lines L1, L2 from power supply PS of the central terminal unit is applied to the sensor unit circuitry by splitting the balanced windings 16S1, 16S2 of a balanced transformer BST1. A coupling capacitor C connects the two windings 16S1 and 16S2 and D.C. power is output from these windings via lines 39 and 37 in accordance with the polarity applied to lines L1 and L2. This D.C. power is fed through EMI filters 22A, 22B and along lines 35, 41 to a diode bridge rectifier 26. Diode bridge 26 provides a positive supply of voltage to the circuit components of the sensor unit regardless of the polarity of the supply from the central terminal unit. This positive voltage is then applied via line 43 to a voltage regulator 28 and is inverted to supply minus and plus supply voltages to all of the components or circuits of the sensor unit by voltage inverter 30 as indicated.

In addition to the D.C. power supply function which the split balanced windings 16S1 and 16S2 provide, a control signal is also extracted from these windings via line 33 coupled to EMI filter 22A. This control signal is either a positive or negative going D.C. signal, depending on the polarity of power supplied under control of polarity reversing switch 32 of the central terminal unit. This control signal is fed via lines 29 and 31 to a program counter 18 and oscillator 20. Program counter 18 is a conventional counter such as a CD 4024 BE manufactured by RCA. Oscillator 20 may be any conventional oscillator for generating a calibration signal along line 25 such as a CD 4001 BE manufactured by RCA connected as an oscillator. Program Counter 18 has a pair of outputs 27 and 23 leading to an FM modulator 14 and a program decoder 22. Program decoder 22 receives a binary count via line 23 from program counter 18 and applies a suitable code through line 21 to a gain control device 24. An additional output on line 19 from program decoder 22 may be provided to other devices not shown to provide additional control functions. Gain control device 24 may be any conventional form of resistive ladder network wherein the resistors of parallel branches are switched in and out of the circuit to provide a different gain control code along line 17 to a low level analog sensor amplifier 12 which receives input signals from a sensor device 10.

Thus, the sensor amplifier 12 may receive both adjustable gain control signals along line 17 and a calibration signal along line 25 from oscillator 20 to adjust the sensor unit to the desired operating point in a manner to be fully described hereinafter. The output of sensor amplifier 12 is transmitted along line 13 to FM modulator 14, which transmits an FM modulated analog output signal along line 15 to a primary winding 16P of balanced shielded transformer BST1. Thus, this signal is coupled to transmission lines L1, L2 through the transformer BST1 and transmitted to the central terminal unit for processing by the FM demodulator 36 described hereinbefore. The use of an FM modulator in combination with a balanced shielded transformer such as BST1 substantially reduces any noise problems experienced by electromagnetic interference (EMI) and precludes the need for shielded transmission lines L1, L2. In fact, inexpensive telephone wire may be used for lines L1, L2 to connect the sensor unit to the central terminal unit over distances of thousands of feet.

DESCRIPTION OF OPERATION

The system of the present invention has two basic modes of operation, namely, a data monitoring mode wherein signals from a sensor such as 10 are FM modulated and transmitted along lines L1 and L2 to the central terminal unit and output through amplifier 40 for analysis; and an adjustment or calibration mode of operation wherein circuit components within the sensor unit such as the gain control device 24 and the sensor amplifier 12, are adjusted and calibrated to a desired operating point. The system may be switched back between the two modes of operation by use of the polarity reversing switch 32, illustrated in FIG. 1. In an initial predetermined polarity of the power supply PS, as controlled by polarity reversing switch 32, the D.C. power supplied to lines L1, L2 enables the sensor unit of FIG. 2 to function at its desired operating point and transmit FM analog data signals back through the same lines L1, L2 to the central terminal unit. In this mode of operation, the program counter 18, decoder 22, gain control device 24 and sensor amplifier 12 are adjusted to states associated with their desired operating point. When adjustment of those operating points is desired, polarity reversing switch 32 is actuated, causing a different polarity signal to be input to program counter 18 and oscillator 20 via lines 33, 29 and 31. The reverse polarity signal on line 29 resets the program counter 18 to zero and enables it to start counting, generating output count signals on lines 27 and 23 to FM modulator 14 and program decoder 22, respectively. Simultaneously, the reverse polarity signal on line 31 turns on oscillator 20 which outputs a calibration signal 25 to sensor amplifier 12. Each advance of the program counter 18 keys the FM modulator 14 so that a tone is sent back via lines L1, L2 to the central terminal unit and the sensor status indicator 38 to indicate the current program count. The program count supplied to program decoder 22 is decoded thereby and controls the gain control circuit 24, and therefore the gain of the sensor amplifier 12 in stepped increments of 10 db. The calibration and adjustment of the sensor unit can be stopped by an operator at the central terminal unit when a desired operating point is achieved, as indicated on the sensor status indicator 38. This may be done simply by a further actuation of polarity reversing switch 32 to its original state to restore the original polarity of D.C. power supply to the lines L1, L2, which immediately removes the signals on lines 29 and 31 and stops program counter 18 and oscillator 20. Accordingly, a single pair of transmission lines L1, L2 provide a signal transmission path in all modes of operation of the system of the present invention, and no additional transmission lines are required for providing power to the remote sensor unit or control signals thereto, as was required in the prior art devices heretofore.

It should be understood that the system described hereinbefore may be modified as would occur to one of ordinary skill in the art without departing from the spirit and scope of the present invention.

What is claimed is:

1. A system for transmitting electrical signals bidirectionally between a remote sensor unit which generates analog data signals and a control terminal unit along a single pair of transmission lines comprising:

power supply means within said control terminal unit for applying D.C. power of a predetermined polarity to said pair of transmission lines for providing D.C. bias to both said sensor unit and control terminal unit, said system operating in a monitoring mode of operation wherein analog data signals from said sensor unit are monitored at said control terminal unit when said power of a predetermined polarity is applied;

polarity reversing means coupled to said power supply means for selectively reversing the polarity of power supplied to said pair of transmission lines to switch said system to an adjustment mode of operation wherein said sensor unit is adjusted to a desired operating point;

adjustment means within said sensor unit responsive to said polarity reversal for initiating the adjustment of said sensor unit and terminating the adjustment at said operating point in response to a change in polarity back to said predetermined polarity; and transmitter means within said sensor unit for sending said analog data signals detected by said sensor unit to said control terminal unit along the same single pair of transmission lines to which said D.C. power is applied during both said monitoring and adjustment modes of system operation.

2. The system of claim 1 wherein said signal transmitter means comprises modulator means for frequency modulating the analog data signals sent along said transmission lines to said control terminal unit.

3. The system of claim 2, further comprising a balanced transformer in said single pair of transmission lines for coupling said modulator means thereto.

4. The system of claim 1, wherein said adjustment means comprises gain control means for said sensor unit.

5. The system of claim 1, wherein said adjustment means comprises calibration means for said sensor unit.

6. The system of claim 1, wherein said sensor unit includes a full wave rectifier coupled between said pair of transmission lines and the power supply inputs of said sensor unit so that D.C. bias supplied to said sensor unit will always have said predetermined polarity of said power supply means.

7. The system of claim 2, further comprising:

detector means within said control terminal unit for demodulating said data signals.

* * * * *